US005346005A

United States Patent [19]

Robbins

[11] Patent Number: 5,346,005

[45] Date of Patent: Sep. 13, 1994

[54] INFLATABLE BOREHOLE PLUG ASSEMBLIES

[75] Inventor: Geoffrey Robbins, St. Peters, Australia

[73] Assignee: Sanleo Holdings Pty. Ltd., Milson's Point, Australia

[21] Appl. No.: 996,185

[22] Filed: Dec. 23, 1992

[30] Foreign Application Priority Data

Dec. 24, 1991 [AU] Australia ..... PL0178
Dec. 24, 1991 [AU] Australia ..... PL0179

[51] Int. Cl.[5] ..... E21B 33/00
[52] U.S. Cl. ..... 166/187
[58] Field of Search ..... 166/187, 188, 179, 185

[56] References Cited

U.S. PATENT DOCUMENTS

| | | | |
|---|---|---|---|
| 3,538,330 | 11/1970 | Youmans | 166/187 |
| 3,613,784 | 10/1971 | Bassani | 166/187 |
| 3,918,520 | 11/1975 | Hutchison | 166/64 |
| 4,609,042 | 9/1986 | Broadus et al. | 166/187 |
| 4,674,570 | 6/1987 | Jackson | 166/187 |
| 4,846,278 | 7/1986 | Robbins | 166/286 |
| 5,228,519 | 7/1993 | Coronado et al. | 166/187 X |

FOREIGN PATENT DOCUMENTS

| | | |
|---|---|---|
| 579395 | 2/1986 | Australia . |
| 595887 | 12/1987 | Australia . |

*Primary Examiner*—Thuy M. Bui
*Attorney, Agent, or Firm*—Morgan & Finnegan

[57] ABSTRACT

The invention relates to inflatable borehole plug assemblies wherein the time required for their inflation may be controlled. In particular, the invention enables inflatable borehole plug assemblies to be lowered to a preselected depth in a borehole before inflation occurs. The inflatable borehole plug assemblies of the invention include a sealed gas-tight inflatable container containing a pressurised vessel having a pressure release valve. The pressurised vessel contains an inflating substance and a time delay liquid, and is adapted so that on operation of the pressure release valve: (i) the time delay liquid is discharged from the pressurised vessel, thereby causing a time delay between the operation of the pressure release valve and discharge of the inflating substance from the pressurised vessel, and (ii) after the time delay liquid has been discharged the inflating substance is discharged, thereby inflating the inflatable container to form a borehole plug.

22 Claims, 3 Drawing Sheets

INFLATABLE BOREHOLE PLUG ASSEMBLIES

TECHNICAL FIELD

The present invention relates to inflatable borehole plug assemblies and to means to control the time required for their inflation. In particular the invention enables inflatable borehole plug assemblies to be lowered to a preselected depth in a borehole before inflation occurs.

BACKGROUND ART

When boreholes are drilled so that explosive charges may be delivered to an underground geological structure, it is important that the charges be placed at appropriate levels in the borehole. Where more than one explosive deposit is to be placed at spaced intervals in a borehole, it has been conventional to apply a column of concrete or the like to a portion of the borehole so that a subsequent explosive charge may be spaced at a distance from, for example, the bottom of the bore hole. The application of concrete or the like to this region of the bore hole is both time consuming and expensive. Further problems arise if the borehole is partially or completely full of water. Some of these problems can be overcome by placing what is known as decking at selected depths in the bore hole.

Different types of decking are known in the art. They may comprise a wooden or concrete disk having a cross-section substantially corresponding with the bore cross-section and lowered by rope to a water surface. It has also been proposed to use as a decking a polyester resin which floats on the water and solidifies after a period of time. More recently, it has also been suggested to replace the decking with a gel-explosive slurry which floats on the water layer. Each of these methods suffer disadvantages. More recent methods are described in Australian Patents Nos. 579 395 and 595 887, the contents of which are incorporated herein by cross-reference. Australian Patent 579 395 describes a borehole plug composed of two or more co-reagents which expand when mixed, separately contained so that they can be mixed when so required and further contained in an outer container adapted to retain the co-reagents during mixing. The container is dimensioned for dropping or lowering down a bore hole. Typically co-reagents react to form a polyurethane foam.

Australian Patent No. 595 887 describes an improvement on that system involving reagents which when mixed create a gas which expands in the container to position the plug at the level in the borehole to which the device has been lowered.

In expansion-type borehole plugs of the type described in Australian Patent Nos. 579 395 and 595 887, the time required for the plug to become fully expanded or inflated is dependent on the rate of reaction of the components of the reactive system employed. During the time before expansion has proceeded far enough to cause the borehole plug to be fixed in position it must be lowered or otherwise located at the desired position. However when the temperature of the reactants varies, the rate of their reaction also varies, often to an unpredictable extent. Borehole temperatures vary depending on their depth, location and the climatic conditions. Thus, it has been found that the expansion-type borehole plugs known to the art are difficult to use in practice because the time required to inflate or expand the plug is difficult to control, making for difficulty in locating the plug at the desired depth in the borehole. In addition, in cold environments reactions causing the release of inflating gases may be very slow, leading to operating delays or even failure of plugs to be effectively fixed in position.

Furthermore, the shelf-life of expansion-type borehole plugs known to the art may be limited owing to the aggressive nature of the chemical reagents involved and the likelihood of physical damage to the containers of the reactive components during transport and storage.

It is an object of the present invention to ameliorate or substantially overcome these difficulties inherent in known borehole plugs.

DESCRIPTION OF INVENTION

In a first embodiment of the present invention there is provided an inflatable borehole plug assembly, comprising a sealed gas-tight inflatable container containing a pressurized vessel having pressure releasing means, said pressurized vessel containing an inflating substance and a time delay liquid, adapted so that on operation of the pressure releasing means (i) the time delay liquid is discharged from the pressurized vessel, thereby causing a time delay between said operation of the pressure releasing means and release of said inflating substance from said pressurized vessel, and (ii) after the time delay liquid has been discharged the inflating substance is discharged, thereby inflating the inflatable container to form a borehole plug.

The time delay before the inflatable container inflates is determined partly by the quantity of the time delay liquid in the pressurized vessel. However, in contrast to the inflatable borehole plugs known in the art, the borehole plug assembly of the present invention has the advantage that the inflation time is substantially independent of the ambient temperature.

In addition the borehole plug assembly of the present invention has the advantage that it may be stored in the uninflated condition for extended periods without deterioration or premature inflation, and is suitably robust for transportation and use in harsh environment.

The pressurized vessel for use in the invention is typically a canister of metal or rigid plastic, inert both to the inflating substance and to the time delay liquid. Usually the container will be constructed from steel or aluminum.

The pressure releasing means is suitably a valve which once opened remains open. On operation of the pressure releasing means, the pressurized vessels is adapted to discharge the time delay liquid before discharging the inflating substance, suitably by means of a pipe or tube connected internally to the valve. The pipe or tube will be adapted to reach substantially to the bottom of the pressurized vessel when the time delay liquid is more dense than the inflating substance, and will reach almost to the bottom of the layer of the time delay liquid when the liquefied inflating substance is the more dense phase. It is preferred that the time delay liquid is the more dense phase.

Known aerosol cans of the "flea bomb" type are suitable for use as the pressurized vessel in borehole plug assemblies of the invention. In these types of cans the pressure releasing means is adapted so that, after the container is charged with the inflating substance and the time delay liquid, pressure is retained in the pressurized vessel until the pressure releasing means is operated, but when the pressure releasing means is operated the contents of the container will be released without interruption until the pressure inside the container is substantially equal to the pressure outside the container.

The inflating substance is a compressed gas, which may liquefy at the pressure in the pressurized vessel. Suitable liquefiable inflating substances include halohydrocarbons such as tetrafluoromethane, methyl chloride, dichlorodifluoromethane, chlorodifluoromethane, dichloromonofluoromethane, ethyl chloride, trichloromonofluoromethane, 1,2-dichloro-, 1,1,2,2-tetrafluoroethane, 1,1-difluoroethane, 1,1-dichloro-1,2,2,2-tetrafluoroethane, 1-chloro-1,1-difluoroethane, ethyl fluoride and octafluorocyclobutane; hydrocarbons such as propane, butane or isobutane, sulphur dioxide or dimethyl ether. Other compressed gases that may be used are carbon dioxide, nitrogen, helium, nitrous oxide, methane, ethane, oxygen and other like gases. Mixtures of one or more gases may also be used. Usually, the pressurized vessel will be charged to a pressure in the range of from about 150 kPa to about 1000 kPa, more usually in the range of from about 170 kPa to about 520 kPa.

The time delay liquid and the inflating substance are selected so as to have low mutual solubility. Water is preferred as the time delay liquid. Most suitably, the inflating substance is a hydrocarbon or a mixture of hydrocarbons. Generally, the inflating substance is a mixture of approximately equal parts of propane and butane. In that case, when water is used as the time delay liquid it forms a lower layer when charged into the pressurized vessel with the inflating substance. When the inflatable borehole plug assembly of the invention is to be utilized under conditions of low (less than a few degree C.) ambient temperature, the time delay liquid may suitably comprise an antifreeze substance. Suitable antifreeze substances are well known and include ethylene/glycol, glycerol, propylene glycol, diethylene glycol, ethanol, methanol, iso-propanol and 1-methoxy-2-propanol.

In one form of the first embodiment of the invention, the inflatable container comprises gas-tight inner and outer containers. Typically, such inflatable containers are multi-layer plastic bags. Plastic materials from which suitable multi-layer bags may be fabricated include rubber or other elastomerics, nylon/surlyn coextrusions, polyethylene, polypropylene, or polyethylene/nylon/polyethylene coextrusions which have suitable strength and suitably low gas permeability. Low linear low density polyethylenes are preferable to other types of polyethylene. Where nylon is included in the material of the containers, it should be of extrusion grade.

Generally, the inflatable container of this form of the invention is a double-layer nylon coextrusion bag, coated with linear low density polyethylene. Low gas permeability can also be achieved by the use of a polyester inner layer or metabolized plastic film.

The inner and outer containers may be sealed by known means, for example heat welding, so as to ensure that the sealed inflatable container is gas-tight.

According to a second embodiment of the invention, there is provided a combination comprising the inflatable borehole plug assembly of the first embodiment, and a substantially non-elastic outer support for the inflatable container. Generally, the outer support is constructed of woven polyproplyene or woven polyethylene. Typically, the outer support is a bag, sleeve or other suitable receptacle within which the inflatable container is disposed.

Usually the outer support of this embodiment is opaque and white, and has a transparent window formed in it so that the pressurized vessel of the inflatable borehole plug assembly, or at least the pressure releasing means thereof inside the inflatable container is visible.

In this embodiment, the inflatable container of the borehole plug assembly is prevented from bulging and stretching when inflated, causing the inflated borehole plug to be retained particularly securely against the sides of the borehole (compared to inflatable plugs which lack a non-elastic woven outer support) and enabling a longer retention of internal pressure. Additionally, when the inflatable container is disposed within the outer support, the rough texture of the woven material of the support provides an efficient frictional grip of the inflated borehole plug against the sides of the borehole. Further, when the material of the outer support is white and opaque any temperature rise inside the pressured vessel is minimized when the assembly is left in the sun. Still further, the outer support can protect the inflatable container against damage when the assembly is pushed or dropped into a borehole.

It is preferred that the inflatable container should be able to withstand 10 to 300 kPa internal pressure and to maintain that pressure for up to six months. More typically, the inflated borehole plug will be required to retain a pressure of from 100 kPa to 170 kPa for up to four weeks. In this way, when the inflatable borehole plug assembly of the present invention is inflated in a borehole, it is typically capable of supporting a direct weight of up to five tonnes, more typically up to three tonnes, loaded on its upper surface.

In the borehole plug of the present invention, the inflatable container is dimensioned for dropping or lowering down a borehole and is adapted for containing the inflating substance after it is released from the pressurized vessel. The inflatable container is further characterized in that it is adapted so as to allow for operation of the pressure releasing means before the borehole plug is dropped or lowered into the borehole. Suitably, this may be achieved by the application of manual pressure to the pressure releasing means through the plastic bag or bags of the inflatable container.

In a third embodiment of the present invention there is provided a method of locating an inflatable borehole plug assembly of the first embodiment in a borehole, comprising the steps of operating the pressure releasing means of the pressurized vessel of the inflatable borehole plug assembly, and placing the borehole plug assembly into the borehole; whereby the time delay liquid is first substantially ejected from the pressure releasing means, wherein the quantity of the time delay liquid is such as to delay release of the inflating substance from the pressurized vessel for a time sufficient to allow the borehole plug assembly to be positioned at a desired depth in the borehole, and the inflating substance is substantially ejected after ejection of the time delay liquid, wherein the quantity of the inflating substance is such as to inflate the inflatable container to form a borehole plug.

The time delay between operation of the pressure releasing means and inflation of the inflatable container may be from about 5 seconds to about 10 minutes. Typically the time delay will be in the range of from about 5 seconds to about 2 minutes, more typically from about 10 seconds to about 40 seconds and even more typically 15, 20, 25, 30, 35 or 40 seconds. The time delay may be adjusted by the selection of the inflating substance and/or the time delay liquid and/or by the selection of the quantity of one or both of them. For example, relatively longer time delays may be achieved by increasing the viscosity and/or the density of the time delay liquid, and relatively shorter time delays may be achieved by the selection of an inflating substance with a relatively higher saturated vapor pressure at normal temperature.

The quantities of the time delay liquid and the inflating substance may be selected by known means. It will be readily appreciated that the quantity of inflating substance will depend on the dimensions of the borehole plug assembly when inflated, the desired inflation pressure and the inflating substance used. The quantity of the time delay liquid will depend on the desired inflation delay and the internal pressure of the pressurized vessel, as well as on the nature of the time delay liquid used. For any selected liquid and internal pressure, the quantity of time delay liquid required to produce a desired delay may be readily determined by a person skilled in the art.

In a first preferred form of the third embodiment of the invention of the borehole plug assembly is lowered into the borehole by means of a pole. To this end, the borehole plug assembly may suitably incorporate an elongate sleeve, the axis of elongation of which is generally aligned with the vertical axis of the plug assembly. The lower end of the sleeve is sealed, and the sleeve is dimensioned to receive an end portion of a pole. The diameter of the sleeve is dimensioned so as to enable the pole to be located readily in the sleeve.

The sleeve may be formed of materials similar to those used to form the inflatable container of the borehole plug assembly, and may be attached to the outer container by known means (which may include heat welding, gluing, or taping). It is preferred that the sleeve extend at least to the bottom and preferably to about two feet below the bottom of the borehole plug assembly.

It is preferred that the sealed bottom end of the sleeve be reinforced if necessary to withstand the downward pressure exerted by the end of the pole when the borehole plug assembly is being pushed down the borehole. Suitably, the reinforcement may be by means of attachment of strong adhesive tape to the bottom end of the sleeve.

By means of the pole, the borehole plug assembly can be pushed down the borehole to the required position while retaining the borehole plug assembly and the pressurized vessel in a substantially vertical position.

The pole used is preferably constructed of resilient plastics to enable it to bend if necessary to follow the contours of the borehole. The pole may comprise a rod or tube of a single long length, or a series of connected individual lengths of sufficient number to position the plug at the required location in the borehole.

Alternatively, the borehole plug assembly of the first embodiment or the combination of the second embodiment may incorporate an elongate stiffening member with its axis generally aligned with the vertical axis of the borehole plug assembly, the upper end of the stiffening member being adapted to releasably engage the end of a pole by means of which the borehole plug assembly may be lowered to the required position in the borehole. The stiffening member may suitably be a rigid pipe, rod or dowel. Usually, the stiffening member is a length of PVC tubing.

In the inflatable borehole plug assembly of the first embodiment, when the inflatable container is a multilayer bag, it is preferred that the stiffening member be affixed between the outermost and next-to-outermost layers. In the combination of the second embodiment, the stiffening member may preferably be attached to the outer surface of the outer support, for example by adhesive tape. The upper end of the stiffening member may be adapted so that the end of the pole may be released from the stiffening member when the borehole plug assembly has been lowered down the borehole to the required position.

For example the lower end of the pole may be tubular and dimensioned to receive the upper end of the stiffening member and retain it by means of a friction fit.

In a second preferred form of the third embodiment of the invention, the inflatable borehole plug of the invention is attached to a length of string or rope, which may be of predetermined length, and lowered or dropped into the borehole to the desired position.

By means of this invention in its various embodiments, a borehole plug can be accurately in a borehole before the expansion of the borehole plug assembly locates the borehole plug firmly against the walls of the borehole at the desired location.

Several such borehole plugs may of course be positioned at different levels in the borehole, and there form decks on which appropriate waterproof explosives can be placed or on which backfill can be placed to contain the blast from an explosive charge located at a lower level in the borehole.

BEST MODE OF CARRYING OUT THE INVENTION

Figure 1:
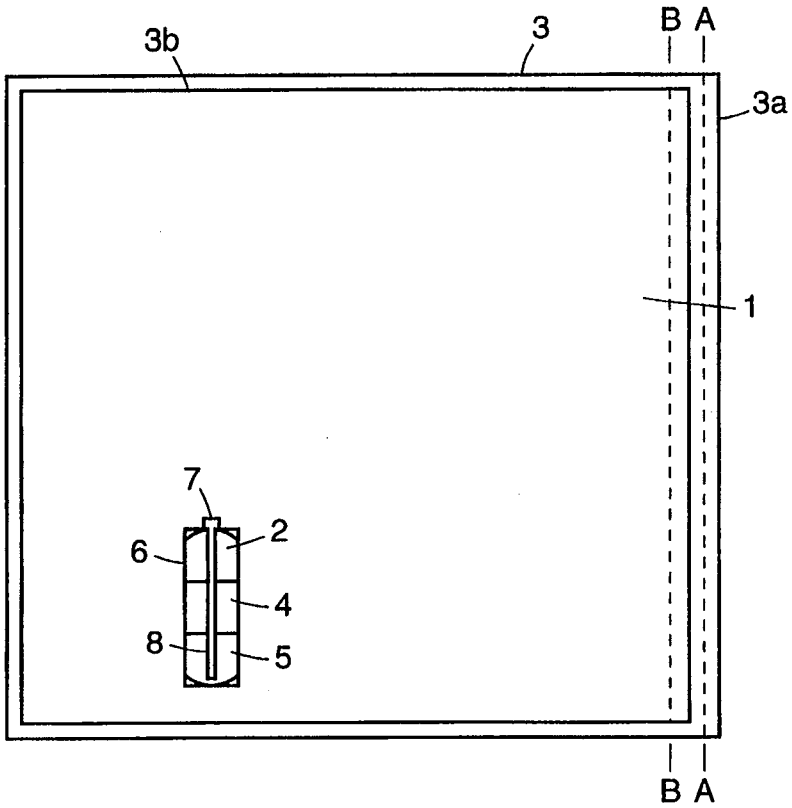
FIG. 1 shows a schematic sectional view of an inflatable plug assembly according to this invention, comprising a two-layer bag as the inflatable container.

FIG. 1 shows a schematic sectional view of an inflatable borehole plug assembly according to this invention. The borehole plug assembly 1 contains pressurized vessel 2 located inside inflatable container 3. The borehole plug assembly is dimensioned such that it can be dropped or lowered into a borehole, often in a rolled or folded configuration. In practice the outer container is usually rolled about a vertical axis for lowering or dropping down the borehole.

In a first preferred form of this invention and as illustrated in FIG. 1, the borehole plug assembly comprises an inflatable double layer bag 3 comprising an outer container 3*a* and an inner container 3*b*, pressurized vessel 2 containing an inflating substance 4 in liquefied form and a time delay liquid 5. In the form illustrated in FIG. 1, the liquefied inflating substance 4 is less dense than the time delay liquid 5. The pressurized vessel 2 comprises a metal shell 6, valve assembly 7 and tube 8 which is connected to valve assembly 7 and adapted to reach as close as possible to the bottom of the metal shell 6.

In one preferred embodiment of the invention, the outer container 3 comprises two bags of polyethylene/-nylon/polyethylene coextrusion or nylon/surlyn coextrusion, the time delay liquid 5 is water and the inflating substance 4 is a mixture of propane and butane. The inner and outer bags are dimensioned so that the inner bag fits readily inside the outer bag. After insertion of the pressurized vessel 2 into the inner bag 3*b*, its open end is heat sealed at B—B. The sealed inner bag 3*b* is then inserted into the outer bag 3*a*, and the open end of the outer bag 3*a* is heat sealed at A—A to form the borehole plug assembly 1.

Figure 2:
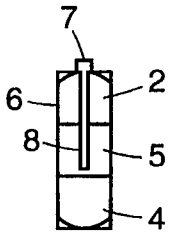
FIG. 2 is a schematic sectional view of an inflatable borehole plug assembly according to this invention.

An alternative pressurized vessel 2, adapted for use where the inflating substance is more dense than the time delay liquid, is illustrated in FIG. 2. In this form, the tube 8 connected to valve assembly 7 is adapted to reach almost to the bottom of the time delay liquid phase 5, which forms above the liquefied inflating substance phase 4.

In use, the plug assembly 1 is folded or rolled generally around the vertical axis of the pressurized vessel 2, a rope or other suitable lowering device is attached to the borehole plug assembly, for example by taping, and the valve assembly 7 is operated to initiate release of the time delay liquid. The borehole plug assembly is then lowered into the borehole to the desired depth. The quantity of time delay liquid 5 is selected so that the inflating substance 4 is not released from the pressurized vessel 2 until sufficient time has elapsed to allow the borehole plug assembly 1 to be lowered to the desired depth. When the time delay liquid 5 has been expelled from the pressurized vessel 2, the inflating substance 4 is discharged, inflating the inflatable container to form a borehole plug.

Figure 3:
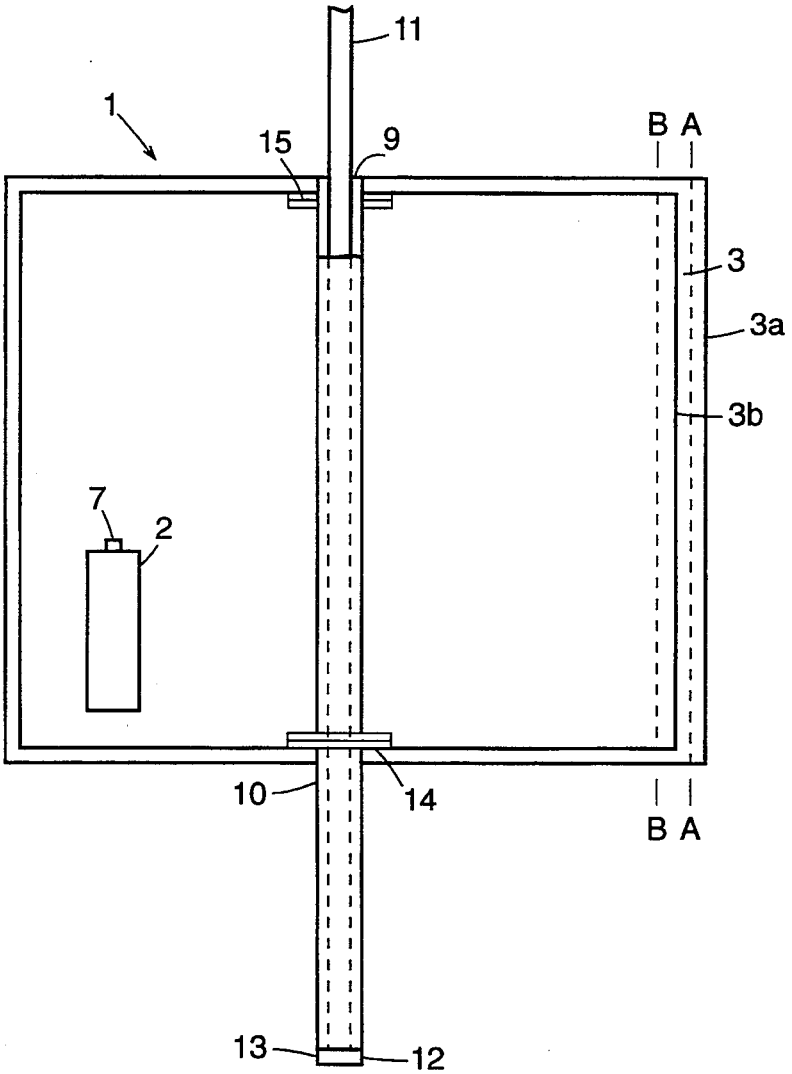
FIG. 3 shows an inflatable borehole plug assembly in an unwrapped condition and incorporating the elongate sleeve of one preferred form of this invention.

FIG. 3 illustrates a borehole plug assembly incorporating an elongate sleeve. The borehole plug assembly 1 comprises an inflatable container 3 comprising outer and inner bags 3*a* and 3*b* respectively, and is modified by affixing an elongate sleeve 10 to the outer bag 3*a*, with the axis of elongation of the sleeve 10 generally aligned with the vertical axis of the borehole plug assembly. The sleeve 10 has an open end 9 to receive a pole 11, and a sealed end 12 reinforced by tape 13 to withstand the pressure exerted by the pole 11 when the borehole plug assembly is being pushed down a borehole.

The sleeve 10 is attached to the outer surface of the outer layer 3*a* of the plug assembly 1 by tapes 14 and 15. It may be attached to the borehole plug assembly before or after the bag edges A—A and B—B are heat welded.

In use the pole 11 is inserted into the sleeve 10, and the borehole plug assembly 1 is folded or rolled generally around the axis of the pole 11; the pressure releasing means 7 is then operated to initiate release of the time delay liquid 5. The borehole lug assembly 1 is then pushed down the borehole to the required position by exerting downward pressure on the pole 11. While the borehole plug assembly 1 is being lowered the time delay liquid (not shown) is being released from the pressurized vessel 2.

Once located at the desired position in the borehole the inflatable container 3 can be allowed to expand to its full capacity, thus firmly positioning it at the required location. The pole 11 can then be withdrawn from the borehole. Expansion occurs when the time delay liquid has been expelled from the pressurized vessel 2 and the inflating substance (not shown) begins to be discharged.

When the inflatable container 3 is inflated to its full capacity, the pole 12 can be detached from the upper end of the stiffening member 10 and withdrawn from the borehole. Explosives or fill can then be loaded onto the top of the borehole plug, depending upon its required purpose.

Figure 4:
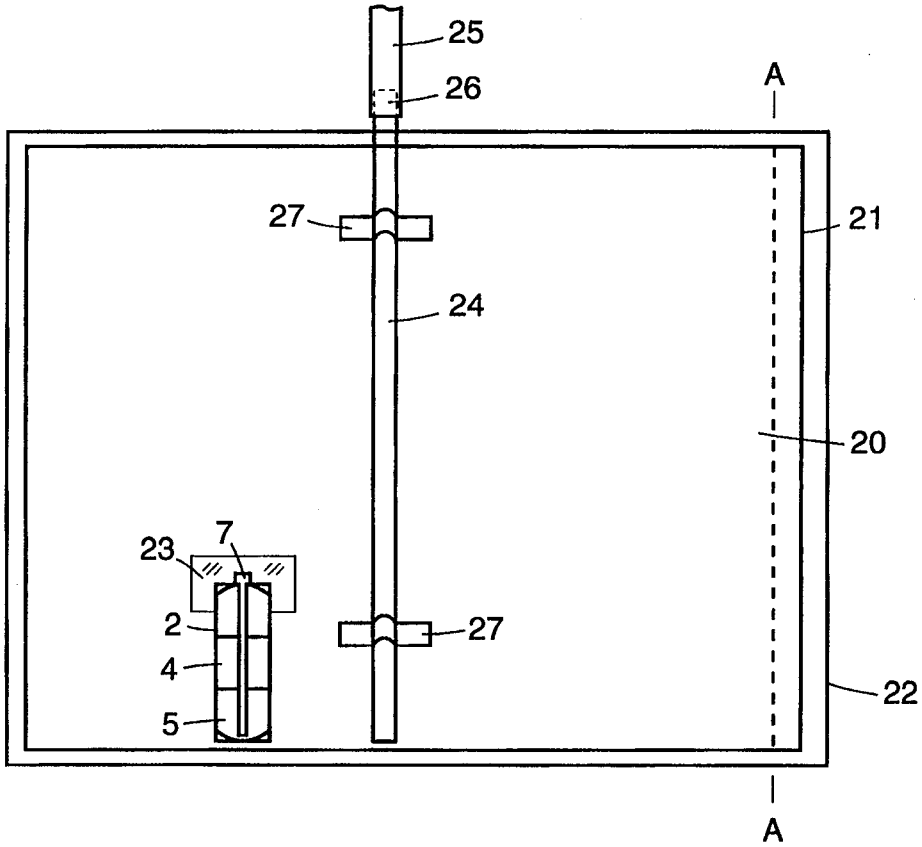
FIG. 4 shows a combination according to the second embodiment of the invention, comprising an inflatable borehole plug assembly (shown in an unwrapped condition), an outer bag as an outer support, and a stiffening member.

FIG. 4 illustrates a combination according to the second embodiment of the invention, comprising and inflatable borehole plug assembly (shown in an unwrapped condition), an outer bag as an outer support, and a stiffening member. The borehole plug assembly 20 comprises an inflatable container 21 formed from a plastic bag which is heat welded along edge A—A to seal it, after pressurised vessel 2, as described above with reference to FIG. 1, has been placed in it. The borehole plug assembly 20 further comprises an outer bag 22 of woven polyethylene or polypropylene. Outer bag 22 is substantially opaque and comprises a window 23 through which the valve assembly 7 of the pressurised vessel 2 may be viewed.

Attached to the outer surface of bag 22 is a length of PVC tubing 24 which extends beyond the upper edge of bag 22. The tubing 24 is attached to bag 22 by means of adhesive tape 27.

In use, one end 26 of a tube or pipe 25 engages by means of an interference fit, the end of tubing 24 which extends beyond the upper edge of bag 22. The borehole plug assembly 20 is then folded around the axis of tubing 24, the pressure releasing means 7 is operated and the assembly 20 is pushed down the borehole, as described above with reference to FIG. 3.

By the use of the form of the invention illustrated in FIG. 3 or FIG. 4, borehole plugs can be positioned at any desired location in a borehole irrespective of the presence of water in the hole and irrespective of the temperature in the borehole. This provides for much greater flexibility and efficiency in blasting, and thus can substantially reduce the amount of explosive needed. In addition, much time can be saved as boreholes which have become partially or completely full of water can still be utilized for effective blasting.

I claim:

1. An inflatable borehole plug assembly, comprising a sealed gas-tight inflatable container containing a pressurized vessel having pressure releasing means, said pressurized vessel containing an inflating substance and a time delay liquid, adapted so that on operation of the pressure releasing means (i) said time delay is discharged from the pressurized vessel, thereby causing a time delay between said operation of the pressure releasing means and release of said inflating substance from said pressurized vessel, and (ii) after the time delay liquid has been discharged the inflating substance is discharged thereby inflating the inflatable container to form a borehole plug; wherein the inflatable container is adapted so as to allow for operation of the pressure releasing means before the inflatable borehole plug assembly is dropped, lowered or pushed into a borehole.

2. An inflatable borehole plug assembly according to claim 1, wherein the pressurized vessel is a canister constructed of a material selected from the group consisting of metal and rigid plastic.

3. An inflatable borehole plug assembly according to claim 1, wherein the inflating substance is selected from the group consisting of tetrafluoromethane, methyl chloride, dichlorodifluoromethane, chlorodifluoromethane, dichloromonofluoromethane, ethyl chloride, trichloromonofluoromethane, 1,2-dichloro-1,1,2,2-tetrafluoroethane, 1,1-difluoroethane, 1,1-dichloro-1,2,2,2-tetrafluoroethane, 1-chloro-1,1-difluoroethane, ethyl fluoride, octafluorocyclobutane, propane, butane, isobutane, sulphur dioxide, dimethyl ether, carbon dioxide, nitrogen, helium, nitrous oxide, methane, ethane and oxygen; or a mixture of two or more thereof.

4. An inflatable borehole plug assembly according to claim 1, wherein the inflating substance is selected from the group consisting of a hydrocarbon and a mixture of hydrocarbons, and the time delay liquid is water.

5. An inflatable borehole plug assembly according to claim 1, wherein the inflating substance comprises from 30% to 70% by weight of butane and from 70% to 30% by weight of propane.

6. An inflatable borehole plug assembly according to claim 1, wherein the inflating substance comprises about 50% by weight of butane and about 50% by weight of propane.

7. An inflatable borehole plug assembly according to claim 1, wherein the time delay liquid is water.

8. An inflatable borehole plug assembly according to claim 1, wherein the pressurized vessel is charged to a pressure in the range of from about 150 kPa to about 1000 kPa.

9. An inflatable borehole plug assembly according to claim 1, wherein the pressurized vessel is charged to a pressure in the range of from about 170 kPa to about 520 kPa.

10. An inflatable borehole plug assembly according to claim 1, wherein the inflatable container comprises at least an inner container and an outer container.

11. An inflatable borehole plug assembly according to claim 1, wherein the inflatable container is a bag comprising multiple layers of plastic.

12. An inflatable borehole plug assembly according to claim 11, wherein the plastic is selected from the group consisting of rubber or other elastomerics, nylon/surlyn coextrusions, polyethylene, polypropylene and polyethylene/nylon/polyethylene coextrusions.

13. An inflatable borehole plug assembly according to claim 1 further including a substantially non-elastic outer support for said inflatable container.

14. An inflatable borehole plug assembly according to claim 13, wherein the outer support is constructed of a material selected from the group consisting of woven polyethylene and woven polypropylene.

15. An inflatable borehole plug assembly according to claim 13, wherein the inflatable borehole plug assembly is disposed within the outer support.

16. An inflatable borehole plug assembly according to claim 13, wherein the outer support comprises a transparent portion through which the pressure releasing means of the pressurised vessel may be viewed.

17. An inflatable borehole plug assembly according to claim 13, further comprising an elongate stiffening member, wherein the axis of said stiffening member is generally aligned with the vertical axis of the inflatable borehole plug assembly, and wherein the upper end of the stiffening member is adapted to releasably engage the end of a pole.

18. An inflatable borehole plug assembly according to claim 17, wherein the lower end of said pole is dimensioned to receive the upper end of the stiffening member and retain it by means of a friction fit.

19. An inflatable borehole plug assembly according to claim 1, further comprising an elongate sleeve having an open upper end and a sealed lower end, wherein the axis of elongation of said elongate sleeve is generally aligned with the vertical axis of the inflatable borehole plug assembly, and wherein said sleeve is dimensioned to receive an end portion of a pole inserted into said open upper end.

20. A method of locating an inflatable borehole plug assembly in a borehole, said inflatable borehole plug assembly comprising a sealed gas-tight inflatable container containing a pressurised vessel having pressure releasing means, said pressurised vessel containing an inflating substance and a time delay liquid, adapted so that on operation of the pressure releasing means (i) said time delay liquid is discharged from the pressurised vessel, thereby causing a time delay between said operation of the pressure releasing means and release of said inflating substances from said pressurised vessel, and (ii) after the time delay liquid has been discharged the inflating substance is discharged thereby inflating the inflatable container to form a borehole plug; wherein the inflatable container is adapted so as to allow for operation of the pressure releasing means before the inflatable borehole plug assembly is dropped, lowered or pushed into a borehole; said method comprising the steps of operating said pressure releasing means of said pressurised vessel, and then placing said inflatable borehole plug assembly into said borehole;

wherein said time delay liquid is discharged from said pressurised vessel, thereby delaying release of said inflating substance from said pressurised vessel for a time sufficient to allow the inflatable borehole plug assembly to be positioned at a desired depth in the borehole, and the inflating substance is substantially ejected after ejection of the time delay liquid.

21. A method of locating an inflatable borehole plug assembly in a borehole, said inflatable borehole plug assembly comprising a sealed gas-tight inflatable container containing a pressurised vessel having pressure releasing means, said pressurised vessel, thereby causing at time delay between said operation of the pressure releasing means and release of said inflating substance from said pressurised vessel, and (ii) after the time delay liquid has been discharged the inflating substance is discharged thereby inflating the inflatable container to form a borehole plug; wherein the inflatable container is adapted so as to allow for operation of the pressure releasing means before the inflatable borehole plug assembly is dropped, lowered or pushed into a borehole; said method comprising the steps of operating said pressure releasing means of said pressurised vessel, and then placing said inflatable borehole plug assembly into said borehole;

wherein said time delay liquid is discharged from said pressurised vessel, thereby delaying release of said inflating substance for from between 5 seconds and 10 minutes, and the inflating substance is substantially ejected after ejection of the time delay liquid.

22. A method according to claim 20, wherein placing said inflatable borehole plug assembly into said borehole comprises the step of lowering said inflatable borehole plug into said borehole.

* * * * *